US007841631B2

(12) United States Patent
Holmes et al.

(10) Patent No.: US 7,841,631 B2
(45) Date of Patent: Nov. 30, 2010

(54) SHOELACE TYING DEVICE

(75) Inventors: Leah D. Holmes, Mequon, WI (US); Ross T. Borchardt, Madison, WI (US); Jacob J. Mikulsky, Denmark, WI (US); David M. Moseler, Peoria, IL (US); Michael E. Vioski, Kansasville, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 44 days.

(21) Appl. No.: 12/333,751

(22) Filed: Dec. 12, 2008

(65) Prior Publication Data

US 2010/0148503 A1 Jun. 17, 2010

(51) Int. Cl.
*B65H 69/04* (2006.01)

(52) U.S. Cl. ..... 289/2

(58) Field of Classification Search ..... 289/2, 289/18.1; 223/113
See application file for complete search history.

(56) References Cited

U.S. PATENT DOCUMENTS

| | | | | |
|---|---|---|---|---|
| 3,458,883 | A * | 8/1969 | Fossa | 12/58.5 |
| 3,498,509 | A * | 3/1970 | Hagenbuch | 223/46 |
| 4,836,587 | A * | 6/1989 | Hinzmann | 289/2 |
| 5,927,764 | A | 7/1999 | Harriman | |
| 6,419,283 | B1 * | 7/2002 | Thomas et al. | 289/2 |
| 6,578,883 | B2 * | 6/2003 | Richmond | 289/16 |
| 2002/0095165 | A1 | 7/2002 | Chan | |
| 2004/0181972 | A1 | 9/2004 | Csorba | |
| 2006/0168784 | A1 | 8/2006 | Ahn | |

* cited by examiner

*Primary Examiner*—Shaun R Hurley
(74) *Attorney, Agent, or Firm*—Boyle Fredrickson, S.C.

(57) ABSTRACT

A shoelace tying apparatus allows individuals with limited or no use of one hand to tightly tie footwear with standard shoelaces. The apparatus is lightweight and portable. The apparatus alleviates the need for special shoelaces or shoes, such as those equipped with hook-and-loop fasteners.

20 Claims, 7 Drawing Sheets

FIG. 2
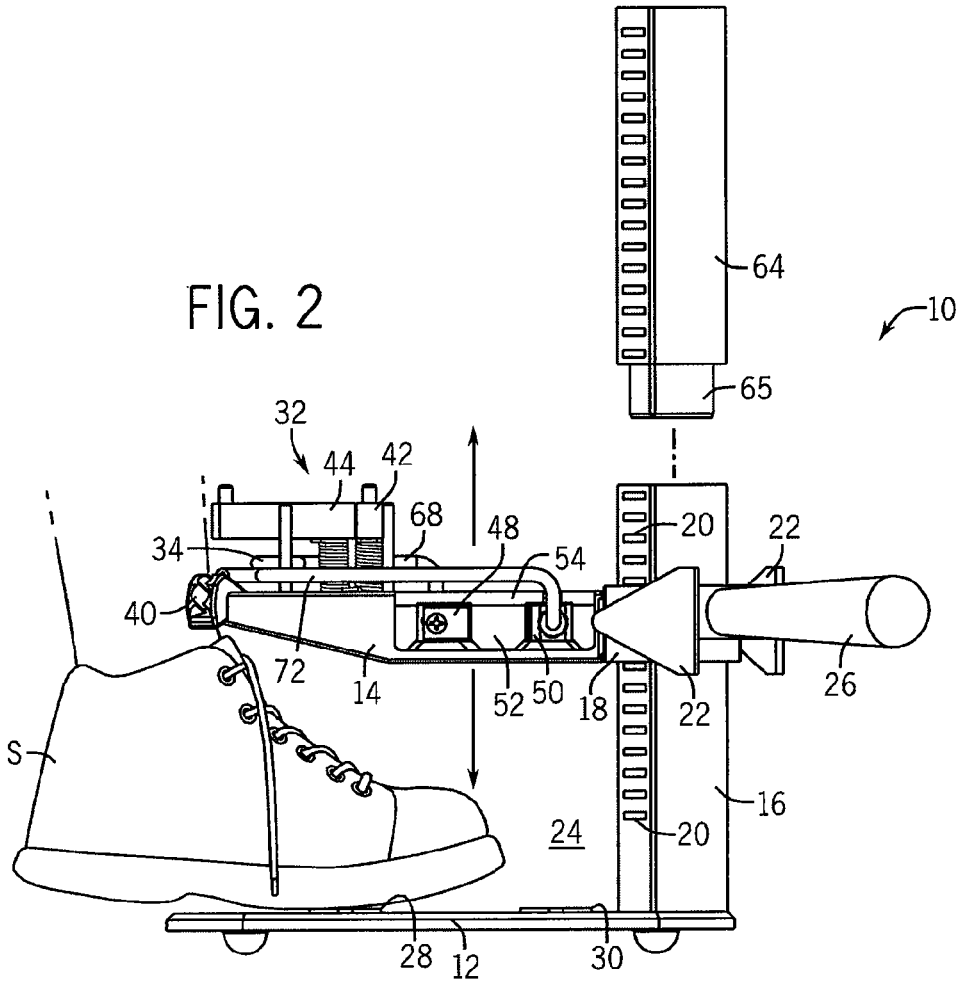
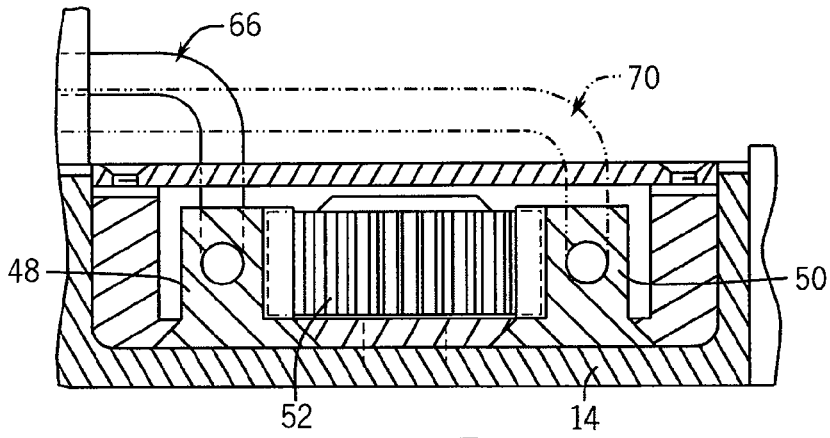
FIG. 5

SHOELACE TYING DEVICE

FIELD OF THE INVENTION

The present invention relates to a shoelace tying device to assist a user with limited hand dexterity in forming a knot in a shoelace.

BACKGROUND OF THE INVENTION

Shoelace tying is a daily activity that can be particularly difficult for people with limited fine motor hand skills. For instance, individuals stricken with birth defects, amputations, strokes, and arthritis can find shoelace tying difficult if not impossible. Such individuals are thus forced to seek the assistance of a care provider or to wear shoes that use hook-and-loop fasteners, e.g., Velcro strips, or shoes outfitted with specially made shoelaces that do not need to be tied in a conventional manner to secure the shoe around the individual's foot. Such specially made shoes and shoes outfitted with Velcro strips however are not always ideal.

For example, a tieless elastic shoelace has been proposed that has plastic disks at each end of the shoelace. The plastic disks are temporarily removed to allow the shoelace to be threaded through the eyelets of the shoe. Once the shoelace is threaded, the disks are secured to the ends of the shoelace and are operative as a stop to prevent the ends of the shoelace from being pulled back through the first eyelets. With such a configuration, the shoelace sets a maximum of the opening formed between the tongue and the counter of the shoe into which the individual can slip the foot into the shoe; however, the shoelace cannot be effectively tightened to snug the shoe around the foot. In this regard, the shoe may not provide the necessary support for the foot and ankle that is needed for athletic activity, such as walking. Another drawback of such special shoelaces is that the original shoelaces that come with the shoes must be removed and replaced, which can be difficult for an individual with limited fine motor skills in one or both hands.

Velcro strips, or other hook-and-loop fasteners, are effective in providing a snug fit of the shoe around the foot. However, shoes equipped with such fasteners are generally not visually appealing and thus are typically not preferred for formal wear or business attire. The individual must then either wear a conventional shoe and seek assistance in tying the shoelaces or wear the unsightly hook-and-loop fastener shoe that can negatively impact the individual's esteem and confidence.

BRIEF DESCRIPTION OF THE INVENTION

The present invention is directed to a shoelace tying apparatus designed to aid individuals with limited or no use of one hand to tightly tie footwear with standard shoelaces. The apparatus is lightweight and portable. In addition, the apparatus alleviates the need for special shoelaces or shoes, such as those equipped with hook-and-loop fasteners.

The apparatus is generally comprised of a stand and a tying device. The stand includes a stand base, a stand arm, a collet, and a tying platform. The stand arm extends upwardly from the base and has a series of vertically spaced notches to which the collet may be selectively secured to accommodate various shoe types and sizes. The tying device is secured to the collet and thus the spacing between the tying device and the stand base may be adjusted by repositioning the collet on the stand arm. The tying device generally includes a pair of hooks, a rack and pinion system, anchor points, and cleats. Once the tying device is secured at a desired height relative to the stand arm, a user may wrap the ends of the shoelace around the anchor points and the hooks and then pull the ends through the cleats to secure the ends to the tying device. The hooks are connected to the rack and pinion system such that movement of one hook automatically causes an equal, but opposite movement of the other hook. Through a series of movements of the free ends of the shoelace and the hooks, which can be performed by an individual with limited dexterity, the shoelace can be tied to a user defined tightness and thus provide a snug fit of the shoe around the foot.

The shoelace tying procedure is summarized below:

A. Place shoe on stand base beneath tying device and adjust height of tying device as needed;

B. Push one of the hooks inwardly toward the center of the tying device;

C. Manually tie slip knot by pulling free ends of the lace down and outward through cleats;

D. Release shoelace from right cleat;

E. Wrap that free end of the shoelace around the right anchor point from front to back;

F. Pull that free end of the shoelace down through the left hook and then toward the front of the tying device, under the right hook;

G. Pull that free end of the shoelace again down through the right cleat;

H. Release the free end of the shoelace from the left cleat;

I. Slide that free end of the shoelace toward the back of the tying device, under all hooks and anchor points;

J. Wrap that free end of the shoelace around the left anchor point from back to front K. Pull that free end of the shoelace down through the right hook;

L. Pull that free end of the shoelace down through the left cleat;

M. Pull outward on one of the hooks until a knot with a desired tightness is formed;

N. Release free ends from the cleats;

O. Push inward on one of the hooks to reset the hooks to their original position; and P. Remove shoelace from hooks.

It will thus be appreciated that the present invention provides a shoelace tying apparatus that assists an individual with tying a shoelace to a desired tightness. The shoelace tying apparatus may be used with a shoe and its original laces thereby avoiding the need for replacement laces. The apparatus can tie the laces of athletic shoes, dress shoes, formal shoes, laced boots, and the like.

It is therefore an object of the invention to assist an individual with limited dexterity with tying the laces of a shoe to provide a snug fit that is suitable for athletic activity, such as walking.

It is another object of the invention to provide a shoelace tying device that is workable with conventional shoelaces.

It is a further object of the invention to provide a shoelace tying device of lightweight and rugged construction.

Therefore, in accordance with one aspect of the invention, a shoelace tying apparatus includes a shoe platform, an arm extending from the shoe platform, and a tying platform connected to the arm and spaced from the shoe platform to define a shoe reception area. The apparatus further includes a pair of reciprocating hooks, anchors, and a pair of lace end retainers supported by the tying platform. Through a series of predefined movements of securing the lace ends to the lace end retainers, anchoring the lace about the anchors, and moving the hooks, a double-loop knot is formed in the shoelace.

In accordance with another aspect of the invention, a shoe tying device includes a first anchor and a second anchor, wherein the first anchor is configured to secure a first free end of a shoelace and the second anchor is configured to secure a second free end of the shoelace. The device also includes a first loop forming element and a second loop forming element that are linked with a rack and pinion arrangement including a first rack connected to the first loop forming element and a second rack connected to the second loop forming element. The rack and pinion arrangement is constructed such that rotation of the rack induced by lateral movement of one loop forming element causes equal and opposite lateral movement of the other loop forming element. Moreover, movement of the loop forming elements from a first position to a second position causes a pulling force to be applied to both free ends of the shoelace such that a first loop is formed in the first free end of the shoelace and a second loop is formed in the second free end of the shoelace with a knot formed between the loops.

According to another aspect of the invention, a knot tying apparatus for forming a double-loop knot when presented with a slip knot is disclosed. The apparatus includes a pair of reciprocating hooks adapted to hold respective free ends of a shoelace in which the slip knot has been formed. A rack and pinion arrangement is connected to the pair of reciprocating hooks and is configured to cause movement of one of the pair of reciprocating hooks in response to movement of the other one of the pair of reciprocating hooks. The apparatus further has a pair of retainers configured to securely hold the free ends of the shoelace such that a knot is formed in the shoelace as the reciprocating hooks are moved away from one another.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings:

FIG. 2 is a side elevation view of the shoelace tying apparatus of FIG. 1 shown relative to a shoe having a shoelace to be tied;

FIG. 5 is a section view of the shoelace tying apparatus taken along line 5-5 of FIG. 4;

DETAILED DESCRIPTION

Figure 1:
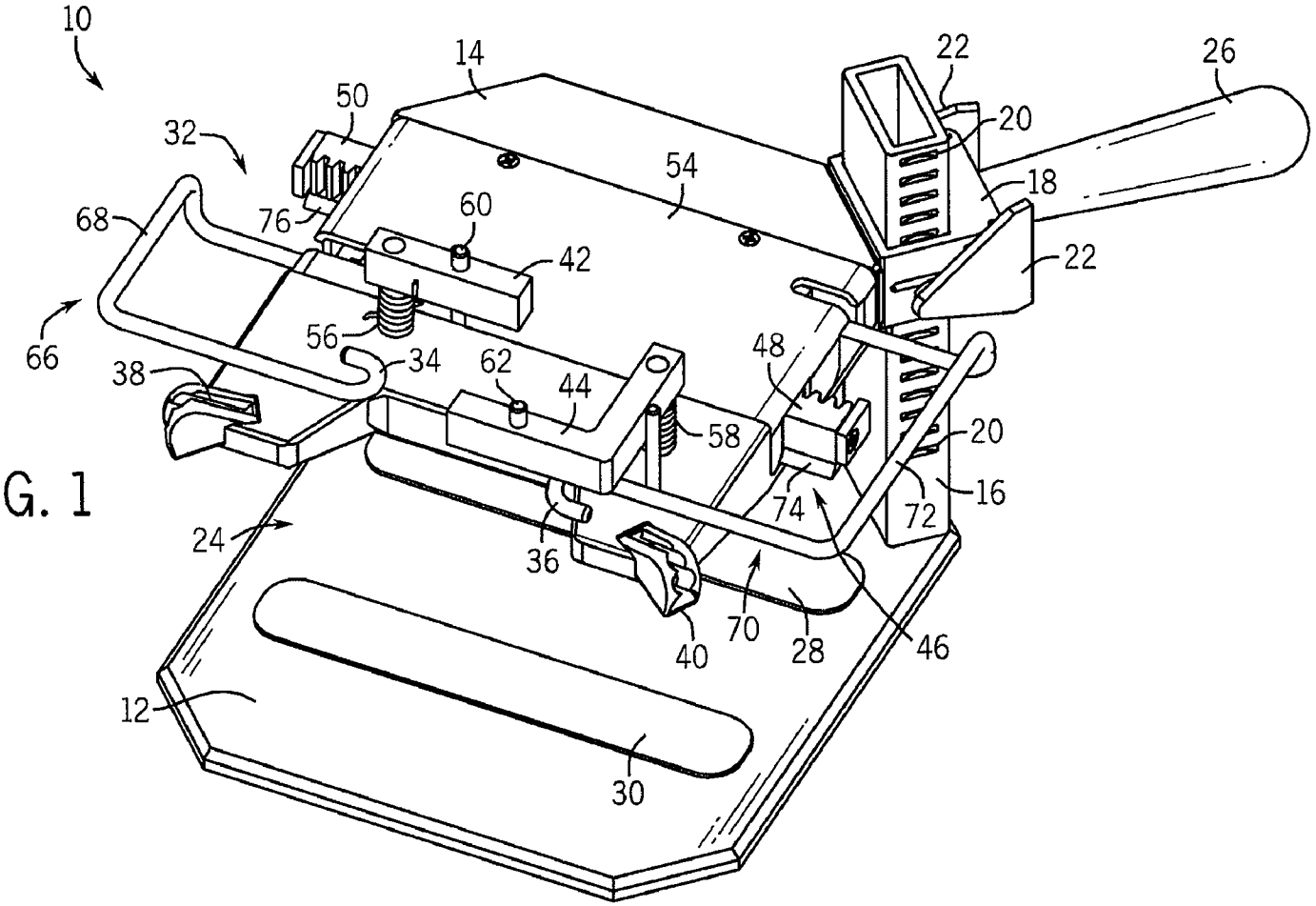
FIG. 1 is a top isometric view of a shoelace tying apparatus according to one embodiment of the invention.

Turning now to FIGS. 1 through 5, a shoelace tying apparatus 10 according to one embodiment of the invention is shown. The shoelace tying apparatus 10 may be used to tie shoelaces of an athletic shoe, casual shoe, dress shoe, laced boot, and other types of shoes having conventional shoelaces. The apparatus 10 generally includes a base 12 and a tying platform 14 held above the base 12 by a stand arm 16. A collet 18 is used to retain the tying platform 14 against the stand arm 16. The stand arm 16 includes a series of notches 20 defined along its length. The collet 18 includes rocker clamps 22 that allow the collet 18 to be positioned at any one of the notches 20 to thus allow a user to vary the distance between the tying platform 14 and the base 12. The rocker clamps 22 have teeth (not shown) that are received in notches 20 of the stand arm 16 to lock the collet 18 and thus the tying platform 14 at a user-desired position on the stand arm 16. This space between the tying platform 14 and the base 12 generally defines a shoe reception area 24. A handle 26 is connected to the collet 18 to assist in moving the collet 18 along the stand arm 16. In a preferred embodiment, the base 12 includes a pair of slip resistant strips 28, 30.

The tying platform 14 also includes a shoelace tying device 32 that generally includes hooks 34, 36, cleats 38, 40, anchors 42, 44 and a rack and pinion gear arrangement 46. The gear arrangement 46 includes a pair of racks 48, 50 spaced from one another and driven by a pinion 52. The pinion 52 and the interfacing of the pinion 52 with the racks 48, 50 sits beneath a gear cover 54. The anchors 42, 44 are mounted to the tying platform 14 by spring loaded pins 56, 58, respectively, that allow the anchors 42, 44 to pivot during knot formation. The anchors 42, 44 also have upwardly extending anchor pins 60, 62, respectively. As will be described, the free ends of a shoelace are held against the anchor pins 60, 62 during the shoelace typing process.

The cleats 38, 40 are designed such that the shoelace may only be pulled out of the cleats 38, 40 in one direction. As such, as a knot is being tied, which will be described in greater detail below, the cleats 38, 40 maintain tension on the shoelace. Once the knot is completed, the free ends of the shoelace may be pulled from the cleats 38, 40 opposite to the direction of loading to free the shoelace from the cleats 38, 40. In a preferred embodiment, the cleats are oriented at a 20 degree angle from the plane of the tying platform 14 and at a 30 degree angle from the front of the tying platform 14. In addition, it is preferred that the cleats are slightly recessed or sunken into the platform 14 to avoid contact with the hooks 34, 36 as the hooks 34, 36 are moved.

The shoelace tying apparatus 10 preferably includes an extension arm 64 that can be magnetically coupled to the stand arm 16 to effectively lengthen the stand arm 16 and increase the number of elevation points at which the tying platform 14 can be positioned. In one preferred embodiment, the extension arm 64 has a plug 65 that is received by an opening formed in the stand arm 16.

Hook 34 is connected to rack 48 by a connecting member 66 that includes a pull handle 68. Similarly, hook 36 is connected to rack 50 by a connecting member 70 that also has a pull handle 72. The connection of the hooks 34, 36 with respective racks 48, 50 of the rack and pinion arrangement 46 allows a user to move the hooks 34, 36 in unison, but in opposite directions by pulling or pushing on only one of the handles 68, 72. That is, the pinion 52 drives both racks 48, 50 to move equally but in opposite directions which in turn causes the hooks 34, 36 to move equally but in opposite directions. The racks 48, 50 are carried by respective slide bars 74, 76 that allow the racks 48, 50 to slide relatively freely along respective linear axes. Preferably, the slide bars 74, 76 are comprised of a material that allows the slide bars 74, 76 to slide along the platform 14 without the need for additional lubricant or oil.

Figure 3:
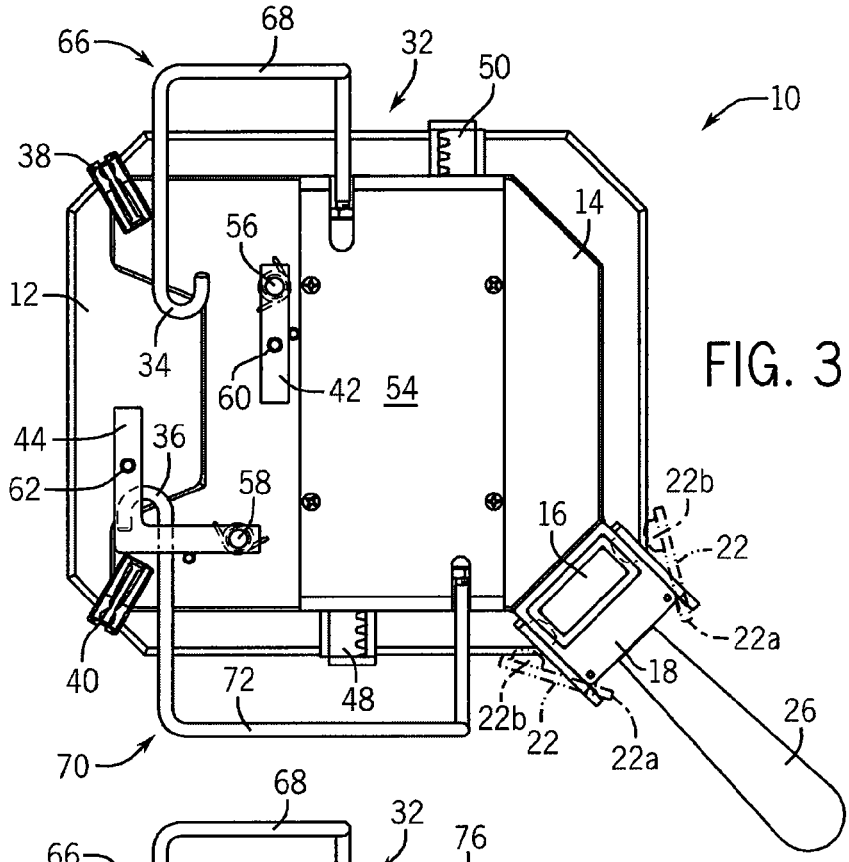
FIG. 3 is a top view of the shoelace tying apparatus of FIG. 1.
Figure 4:
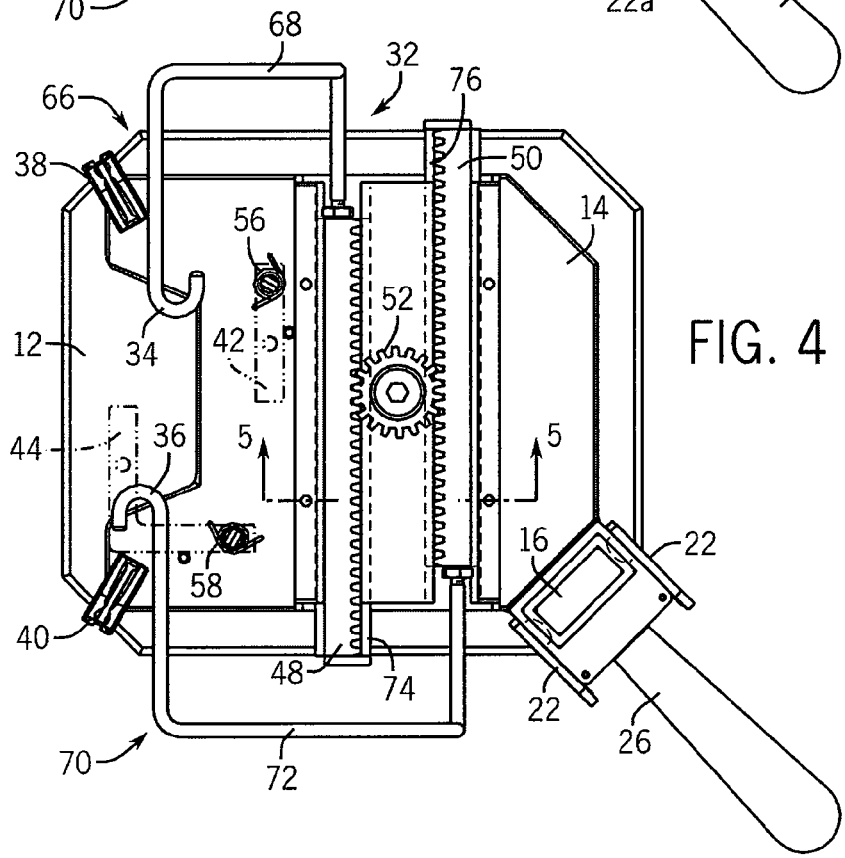
FIG. 4 is a top view of the shoelace tying apparatus of FIG. 1 with a gear cover removed exposing a rack and pinion gear arrangement.

With particular reference to FIG. 3, the rocker clamps 22 are spring loaded which allows a user to squeeze ends 22*a* of the clamps 22 toward one another to disengage the teeth 22*b* of the clamps 22 from the stand arm 16 (or extension arm 64, if applicable) and thus release the collet 18 from the stand arm 16. While holding handle 26, the user may then slide the collet 18 along the stand arm 16 to a desired position to accommodate the user and the size of the shoe, S, to be loaded into the shoe reception area 24.

Operation of the shoelace tying apparatus 10 to form a knot in the shoelace 78 of a shoe S will be described with respect to FIGS. 6 through 12. As will be readily appreciated, the shoelace tying apparatus 10 is operative to form a conventional knot 80 in shoelace 78 of shoe S as shown in FIG. 13. For purposes of explaining the knot forming process, it will be assumed that the user has set the tying platform 14 to a desired height relative to the stand arm 16 as described above.

Figure 6:
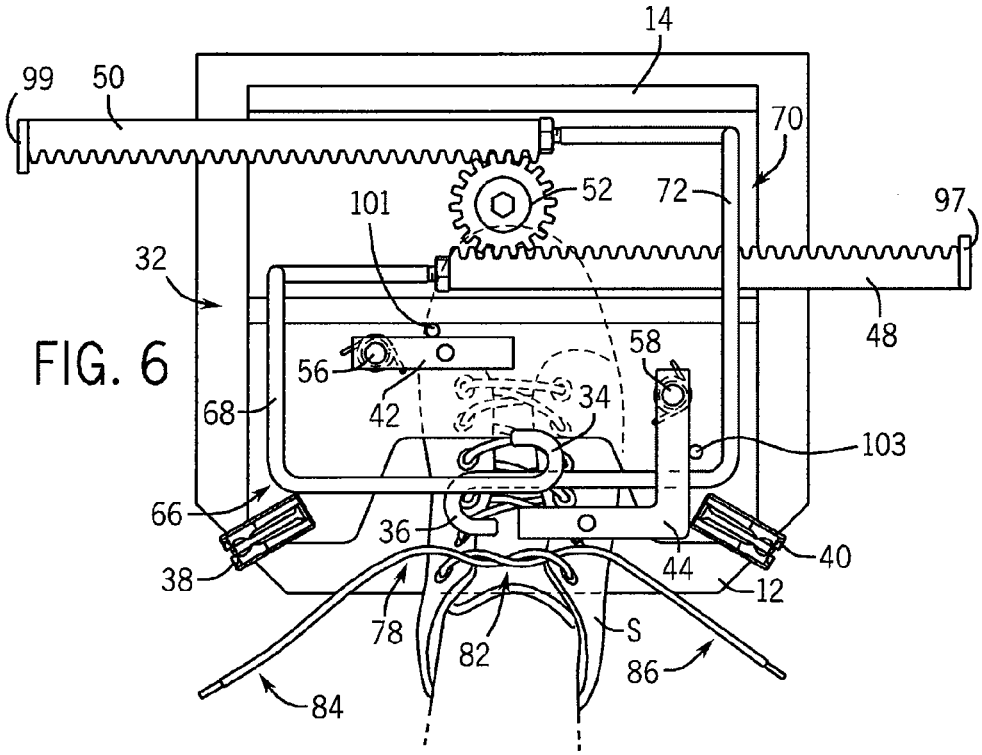
FIG. 6 is a top view of the shoelace tying apparatus with the gear cover removed and positioned at an initial position for tying the shoelace of a shoe shown in a shoe tying position.

Referring now to FIG. 6, the shoelace tying apparatus 10 is designed to form a knot in a shoelace 78; however, the shoelace 78 must be presented with a slipknot 82 formed therein. In this regard, the shoelace tying apparatus 10 is best suited for a user with full use of at least one hand or sufficient dexterity in one hand to form such a slipknot 82. The shoelace tying device 32 must also be set at an initial position which is shown in FIG. 6. In the initial position, the handles 68, 72 are pushed fully toward one another. This is achieved by pushing one of the handles 68, 72 inwardly toward the center of the platform 14, e.g., toward pinion 52. The rack and pinion arrangement 46 described above automatically causes the other rack 48 or 50 to move in the opposite direction. As such, both hooks 34, 36 can be positioned at the initial position by pushing on only one of the handles 68 or 72. With the slipknot 82 formed in the shoelace 78, the shoe S is presented to the shoe reception area 24.

Figure 7:
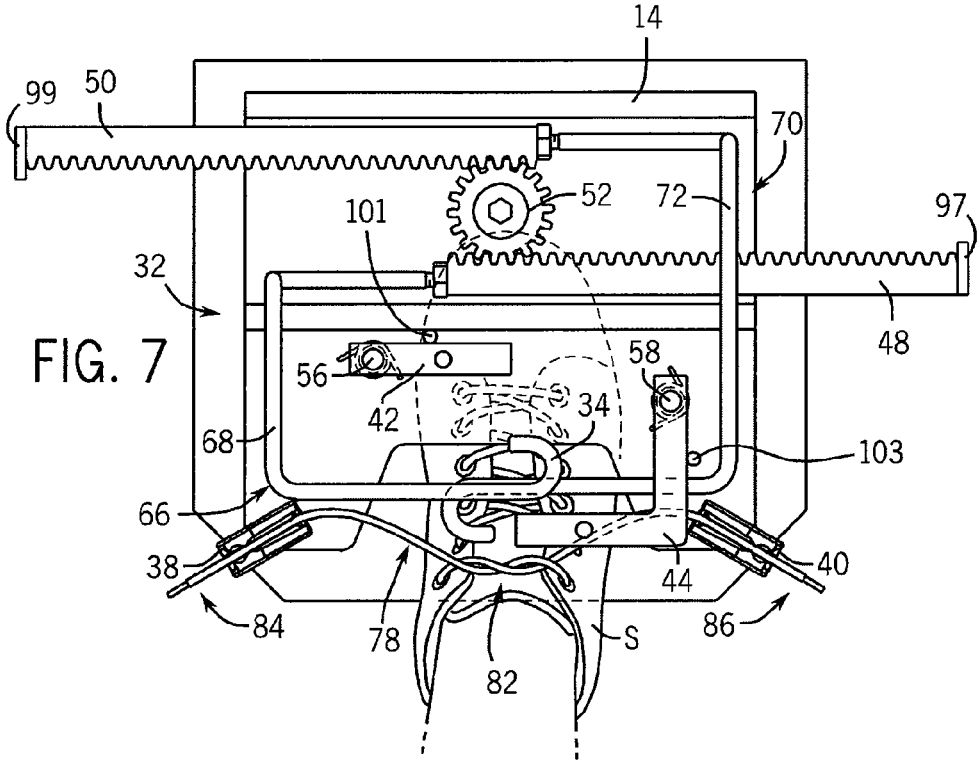
FIG. 7 is a top view of the shoelace tying apparatus with the free ends of the shoelace shown secured to a pair of retainers.

In the next step, shown in FIG. 7, the free ends 84, 86 of the shoelace 78 are secured in cleats 38, 40, respectively. As described above, the cleats 38, 40 are designed to hold the free ends 84, 86, respectively, so that tension is created in the shoelace 78. The free ends 84, 86 are pulled until the slipknot 82 has a desired tightness.

Figure 8:
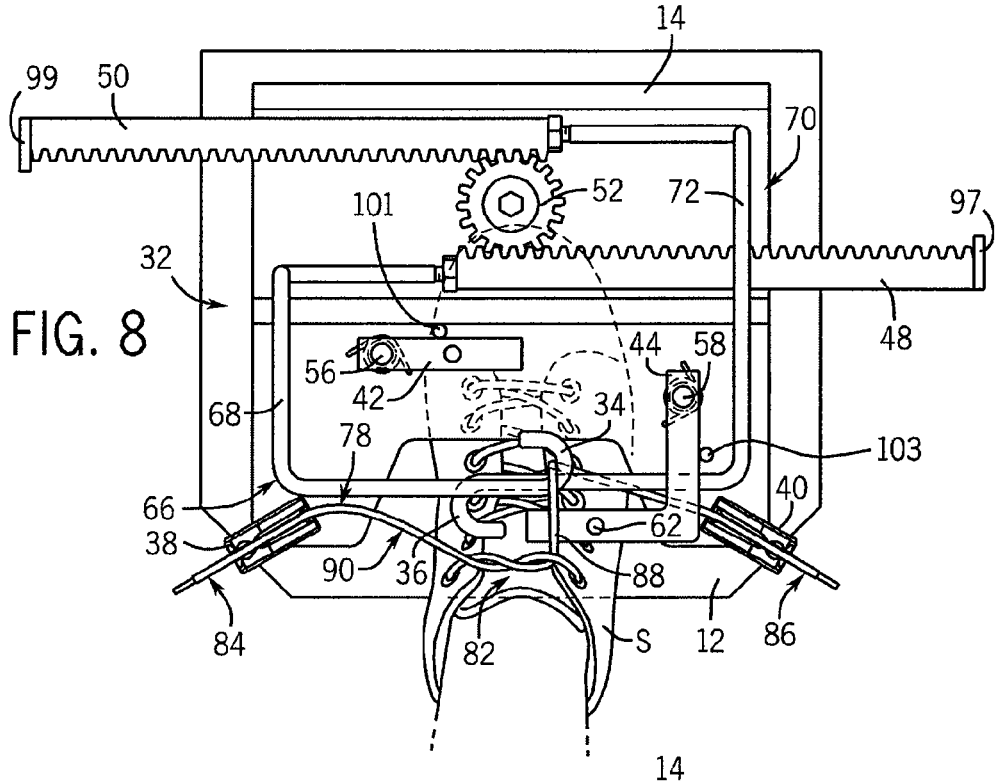
FIG. 8 is a top view of the shoelace tying apparatus with the one end of the shoelace held by a loop forming element and an anchor.

In the next step, shown in FIG. 8, free end 86 is removed from cleat 40 and routed over anchor 44 and against hook 34, then under anchor 44 and connecting member 70, and then back into engagement with cleat 40. As a result of this movement, a shoelace portion 88, which is defined between slipknot 82 and free end 86, is hooked around hook 34 and abuts against the left side of anchor pin 62. The free end 84 of the shoelace 78 remains secured in cleat 38 which maintains tension in the slipknot 82.

Figure 9:
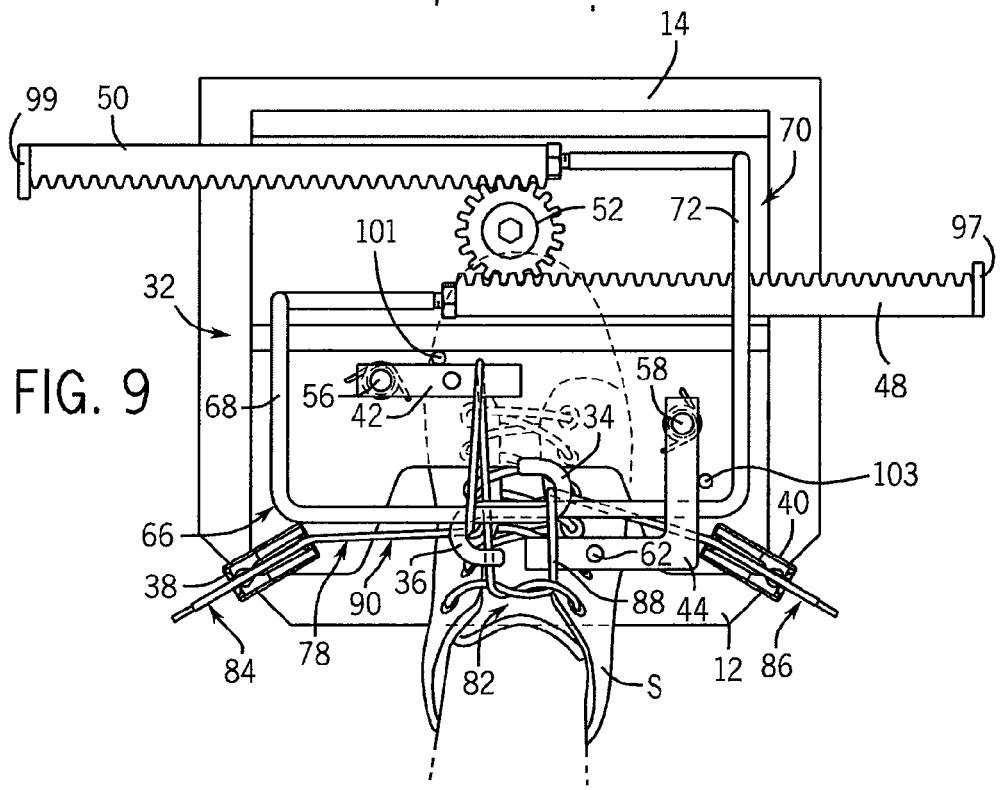
FIG. 9 is a top view of the shoelace tying apparatus with the other end of the shoelace held by a loop forming element and an anchor.

In the next step, shown in FIG. 9, the free end 84 of the shoelace 78 is disengaged from cleat 38 and routed beneath connecting members 66, 70, up and around anchor 42, against hook 36, and then back into engagement with cleat 38. This movement results in a shoelace portion 90, which is defined between knot 82 and free end 84, being routed around anchor 42 and into engagement with hook 36.

Figure 10:
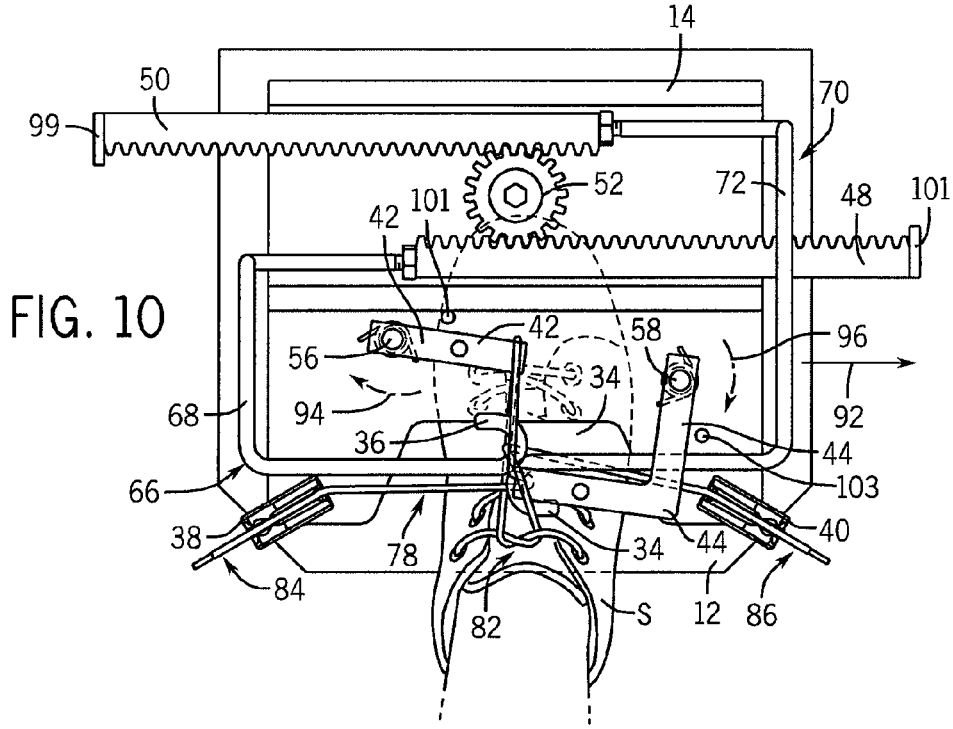
FIG. 10 is a top view of the shoelace tying apparatus after some movement of the loop forming elements away from one another to begin formation of a pair of loops in the shoelace.

In the next step, shown in FIG. 10, handle 72 is pulled away from the platform 14, as designated by arrow 92. This causes an equal yet opposite movement of handle 68 away from the platform 14. More particularly, as handle 72 is pulled in direction 92, hook 34 is pulled in the same direction. Hook 36 is pulled in the opposite direction. The tension in the shoelace 78 causes the anchors 42, 44 to pivot in a clockwise direction, signified by arrows 94 and 96. This rotational movement of the anchors 42, 44 causes the portions 88, 90 to slide along the anchors 42, 44. It is noted that each rack 48, 50 includes a rack stop 97, 99, respectively, that limit how far the handles 68, 72 may be translated away from one another.

Figure 11:
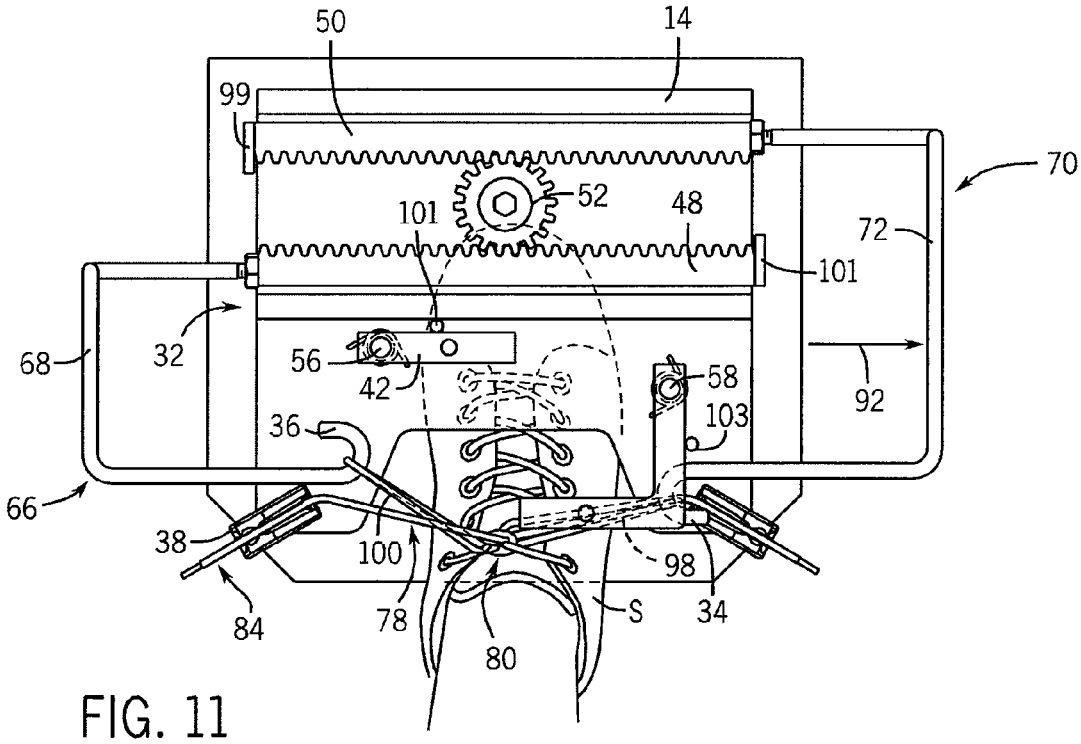
FIG. 11 is a top view of the shoelace tying apparatus with loops formed in the shoelace.

With continued movement of the handles 68, 72 and thus hooks 34, 36, the shoelace portions 88, 90 will slide completely off the anchors 42, 44, as shown in FIG. 11. When the shoelace portions 88, 90 have slid completely off the anchors 42, 44, the tension placed on the anchors 42, 44 will be removed and the spring bias of the anchors 42, 44 will cause the anchors 42, 44 to return to their default positions against stops 101 and 103.

As further shown in FIG. 11, the aforementioned movement of the hooks 34, 36 causes loops 98, 100 to be formed in the shoelace 78 as well as a conventional knot 80. The size of the loops 98 depends on how far handle 72 is moved away from the platform 14 and the amount of slack in the shoelace 78 between the free ends 84, 86 and the slipknot 82. The cleats 38, 40 prevent the free ends 84, 86 of the shoelace 78 from being pulled back through the knot 80 as the hooks 34, 36 continue to be pulled away from the knot 80.

Figure 12:
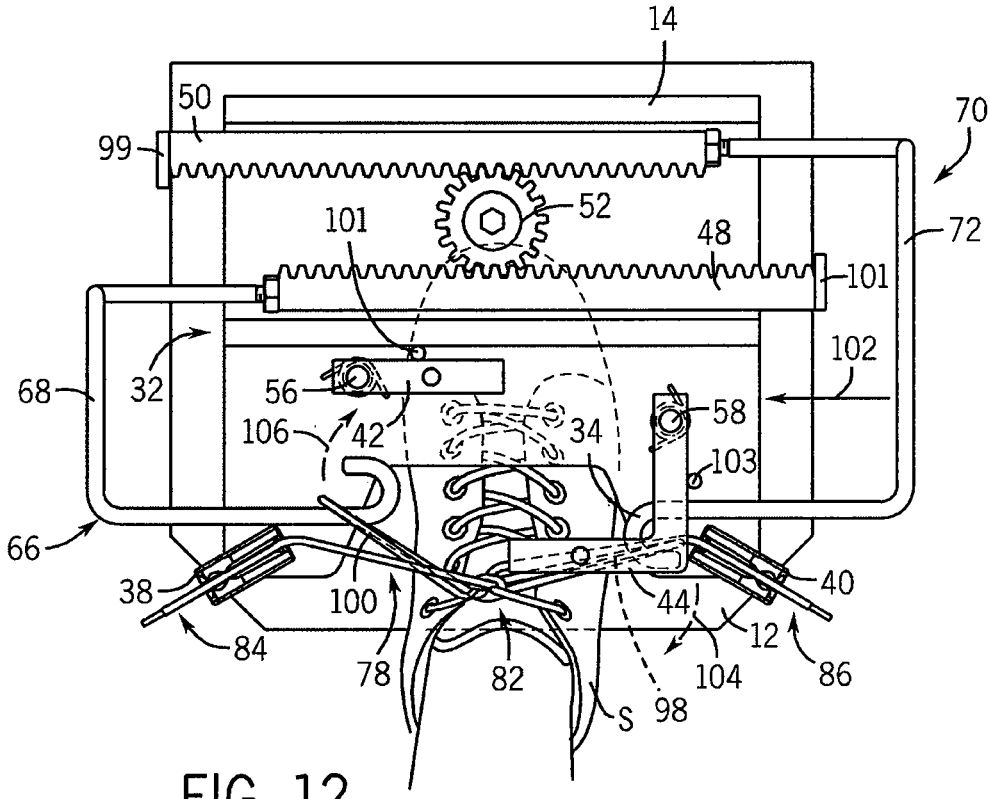
FIG. 12 is a top view of the shoelace tying apparatus with limited reversing of the loop forming elements to allow the loops to be released from the loop forming elements.
Figure 13:
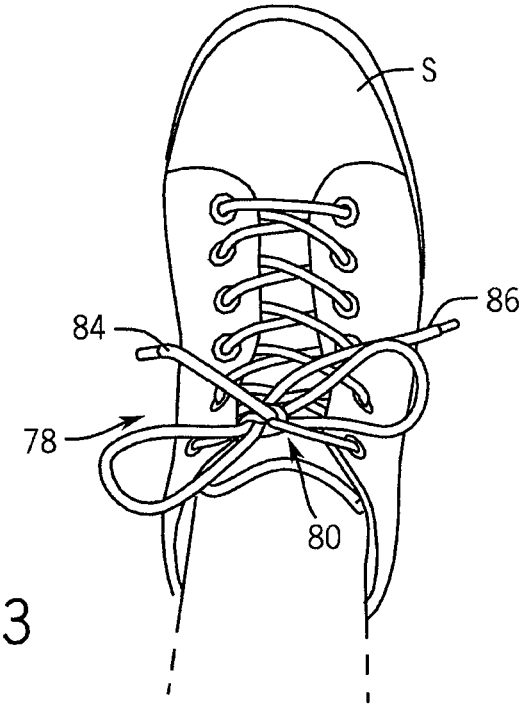
FIG. 13 is a top view of the shoe with a double-loop knot made therein using the shoelace tying apparatus shown in FIGS. 1 through 12.

In the next step, which is shown in FIG. 12, handle 72 is pushed back toward the platform 14, as represented by arrow 102. This reverse movement is necessary to release the tension between the hooks 34, 36 and the shoelace 78. With the tension released, the loops 98, 100 can be disengaged from the hooks 34, 36 respectively, by movement of the loops 98, 100 away from the hooks 34, 36, as represented by arrows 104 and 106, respectively. It is preferred that the handle 72 is pushed in direction 102 back to its initial position, shown in FIG. 6. Such a movement resets both hooks 34 and 36. The free ends 84, 86 may then be released from their respective cleats 38, 40 and the shoe S pulled away from the shoelace tying apparatus 10 resulting in a conventional shoelace tying knot 80, as illustrated in FIG. 13.

The aforementioned steps may then be repeated, as needed, for the other shoe. It will thus be appreciated that the present invention may be used to tie the shoelaces of a conventional shoe, including athletic, casual, business, and formal shoes. Thus, the present invention is particularly advantageous for users with limited hand dexterity who wish to wear conventional shoes without the need for caregiver assistance or special shoelaces.

In one alternate embodiment, the shoelace typing apparatus includes a fixed base and the shoe platform is movable along the stand arm. This alternate embodiment allows the shoe platform to be raised to accommodate users who have difficulty in bending fully to otherwise use the shoelace tying apparatus.

Many changes and modifications could be made to the invention without departing from the spirit thereof. The scope of these changes will become apparent from the appended claims.

We claim:

1. A shoelace tying apparatus for tying the shoelace of a shoe, comprising:

a shoe platform for receiving the shoe;

an arm extending upwardly from the shoe platform;

a tying platform connected to the arm and spaced from the shoe platform to define a shoe reception area;

a pair of axially reciprocating hooks supported by the tying platform;

an anchor supported by the tying platform; and a pair of lace end retainers supported by the tying platform; and wherein through a predefined sequence of movements of securing free ends of the shoelace to the lace end retainers, anchoring a free end about the anchor, and movement of the hooks, a double-loop knot is formed in the shoelace.

2. The apparatus of claim 1 further comprising a gear arrangement and wherein the pair of hooks are associated with the gear arrangement such that movement of one hook automatically causes an equal, but opposite movement of the other hook.

3. The apparatus of claim 2 further comprising a gear cover connected to the tying platform and defining an enclosure for the gear arrangement.

4. The apparatus of claim 2 wherein the gear arrangement includes a first rack associated with the one hook and a second rack associated with the other hook and a pinion configured to translate the first and the second racks in opposite axial directions.

5. The apparatus of claim 1 wherein the anchor includes an anchor pin against which one free end of the shoelace is held when the one free end of the lace is secured in a corresponding retainer.

6. The apparatus of claim 1 further comprising an extension arm selectively connectable to the arm extending upwardly from the shoe platform to expand the range of positions at which the tying platform can be positioned above the shoe platform.

7. The apparatus of claim 1 further comprising a slip retardant affixed to a top surface of the shoe platform.

8. The apparatus of claim 1 further comprising a collet interconnecting the tying platform to the arm.

9. The apparatus of claim 8 further comprising a handle associated with the collet and operative to selectively release the collet from engagement with the stand arm to allow repositioning of the tying platform with the stand arm.

10. A shoe tying device for tying a shoelace having a first and a second free end, comprising:

a first anchor and a second anchor, the first anchor configured to secure the first free end of the shoelace and the second anchor configured to secure the second free end of the shoelace;

a first loop forming element and a second loop forming element;

a rack and pinion arrangement including a first rack connected to the first loop forming element and a second rack connected to the second loop forming element;

wherein:

rotation of the rack induced by lateral movement of one loop forming element causes equal and opposite lateral movement of the other loop forming element; and movement of the loop forming elements from a first position to a second position causes a pulling force to be applied to both free ends of the shoelace such that a first loop is formed in the first free end of the shoelace and a second loop is formed in the second free end of the shoelace and a knot formed between the loops.

11. The device of claim 10 further comprising a first retainer configured to tightly hold the first free end of the shoelace during movement of the loop forming elements from the first position to the second position and a second retainer configured to tightly hold the second free end of the shoelace during movement of the loop forming elements from the first position to the second position.

12. The device of claim 11 wherein the retainers prevent movement of the free ends of the shoelace in one direction but allow movement of the free ends of the shoelace in an opposite direction.

13. The device of claim 10 wherein the first anchor includes a first stopping pin against which the first free end is held and the second anchor includes a second stopping pin against which the second free end is held.

14. The device of claim 10 further comprising a tying platform and wherein the first and the second anchors, the first and the second loop forming elements, and the rack and pinion arrangement are carried by the tying platform, and further comprising a base variably spaced from the tying platform by an upright arm.

15. The device of claim 14 further comprising a collet interconnecting the tying platform to the arm, and wherein the collet may be slid along the upright arm to position to the tying platform at a user-desired height relative to the base.

16. The device of claim 14 further comprising a strip of slip resistant material secured to a top surface of the base.

17. The device of claim 14 wherein the first and the second anchors are pivotably mounted to the tying platform such that the anchors may deflect as the loops are formed in the free ends of the shoelace.

18. A knot tying apparatus for forming a double-loop knot when presented with a slip knot, the apparatus comprising:

a pair of reciprocating hooks adapted to hold respective loops of a shoelace in which the slip knot has been formed;

a rack and pinion arrangement connected to the pair of reciprocating hooks and configured to cause movement of one of the pair of reciprocating hooks in response to movement of the other one of the pair of reciprocating hooks; and a pair of retainers configured to securely hold the free ends of the shoelace such that the double-loop knot is formed in the shoelace as the reciprocating hooks are moved away from one another.

19. The knot tying apparatus of claim 18 further comprising a pair of anchor points against which the free ends of the shoelace are held as the hooks are moved away from one another.

20. The knot tying apparatus of claim 18 wherein the retainers prevent movement of the free ends of the shoelace in one direction yet allow movement of the free ends of the shoelace in an opposite direction.

* * * * *